United States Patent [19]

Altherr

[11] Patent Number: 4,984,696

[45] Date of Patent: Jan. 15, 1991

[54] RAILWAY COUPLER HEAD STRENGTHENED AT HORN LINE

[75] Inventor: Russell G. Altherr, Munster, Ind.

[73] Assignee: Amsted Industries Incorporated, Chicago, Ill.

[21] Appl. No.: 448,370

[22] Filed: Dec. 11, 1989

[51] Int. Cl.[5] ..... B61G 3/00

[52] U.S. Cl. ..... 213/151; 213/100 R; 213/104

[58] Field of Search ..... 213/100 R, 100 W, 104, 213/105, 109, 114, 78, 150, 151, 152, 153, 154, 77

[56] References Cited

U.S. PATENT DOCUMENTS

| | | | |
|---|---|---|---|
| 679,629 | 7/1901 | Lennon | 213/114 |
| 3,767,062 | 10/1973 | Holibaugh | 213/127 |
| 3,854,599 | 12/1974 | Day et al. | 213/100 R |
| 4,129,219 | 12/1978 | Polanin | 213/100 R |
| 4,438,855 | 3/1984 | Altherr | 213/153 |

FOREIGN PATENT DOCUMENTS

| | | | |
|---|---|---|---|
| 95753 | 1/1924 | Austria | 213/112 |

*Primary Examiner*—Robert P. Olszewski
*Assistant Examiner*—S. Joseph Morano
*Attorney, Agent, or Firm*—Edward J. Brosius; Charles E. Bouton

[57] ABSTRACT

An improved railway coupler head is provided having a modified lock chamber which is asymmetrical about its longitudinal center line such that the rear horn wall has a greater length on the guard arm side than the knuckle side of the longitudinal center line and the knuckle side wall has a shorter length than the guard arm side wall. The modified lock chamber creates an increase in the section area of the top face of the coupler head and allows for a reduction in stress concentration as the forces transmitted through the top face are distributed over the increased section area.

2 Claims, 2 Drawing Sheets

RAILWAY COUPLER HEAD STRENGTHENED AT HORN LINE

BACKGROUND OF THE INVENTION

The present invention relates to railway vehicle couplers and more particularly to an improved railway coupler head having a modified lock chamber.

Both AAR Type E and Type F railway couplers are known to have coupler heads with substantially horizontal top faces that transfer draft or pulling as well as buff or compression forces to corresponding top faces of coupler shanks. Further, both type coupler heads are known with lock chambers that project upwardly from these top faces and which have substantially vertical knuckle side walls which transfer draft and buff forces to the top faces of the coupler heads which then transfer these additional forces to the corresponding top faces of the coupler shanks. The transverse line at the rear of the lock chamber where the top face of the coupler head meets the top face of the coupler shank is known as the coupler horn line.

A problem with the coupler heads used currently is that the top face narrows drastically between an arcuate shaped edge of the knuckle side face and the lock chamber as the horn line is approached. This restricted width of the top face as well as a lock chamber configuration in which a knuckle side wall meets a rear horn wall abruptly at a radiused corner results in a high concentration of stress at the knuckle side of the horn line due to the forces being transmitted through the knuckle side of the top face and the knuckle side wall of the lock chamber which must, in turn, be transmitted across a significant width of the top face of the coupler shank. The stress concentration in the coupler head top face and the stress concentration in the lock chamber knuckle side wall are additive and are each at a near maximum at substantially the same location at the horn line. Due to the magnitude of these forces, a number of coupler failures have been experienced at the narrowed section of the top face at the horn line between the arcuate edge and the lock chamber.

SUMMARY OF THE INVENTION

Accordingly, it is an object of the present invention to provide an improved coupler head with a reduced stress concentration at the narrowed section of the top face at the horn line between the arcuate edge and the lock chamber.

It is another object of the present invention to provide a modified lock chamber which will result in both an advantageous redirection of forces away from the knuckle side of the coupler and a greater section area of the top face at the horn line between the arcuate edge and the lock chamber.

By the present invention, it is proposed to overcome the difficulties encountered heretofore. To this end, it has been discovered that a lock chamber which is asymmetrical with respect to its longitudinal center line, such that its rear horn wall has a greater length on the guard arm side of the longitudinal center line than the knuckle side of the longitudinal center line, and such that the knuckle side wall has a shorter length than the guard arm side wall, results in a greater section area for the top face of the coupler head at the horn line between the arcuate edge and the lock chamber. Such a modification will reduce the concentration of stress at the desired location by distributing the forces over a greater section area.

DESCRIPTION OF THE PREFERRED EMBODIMENT

Figure 1:
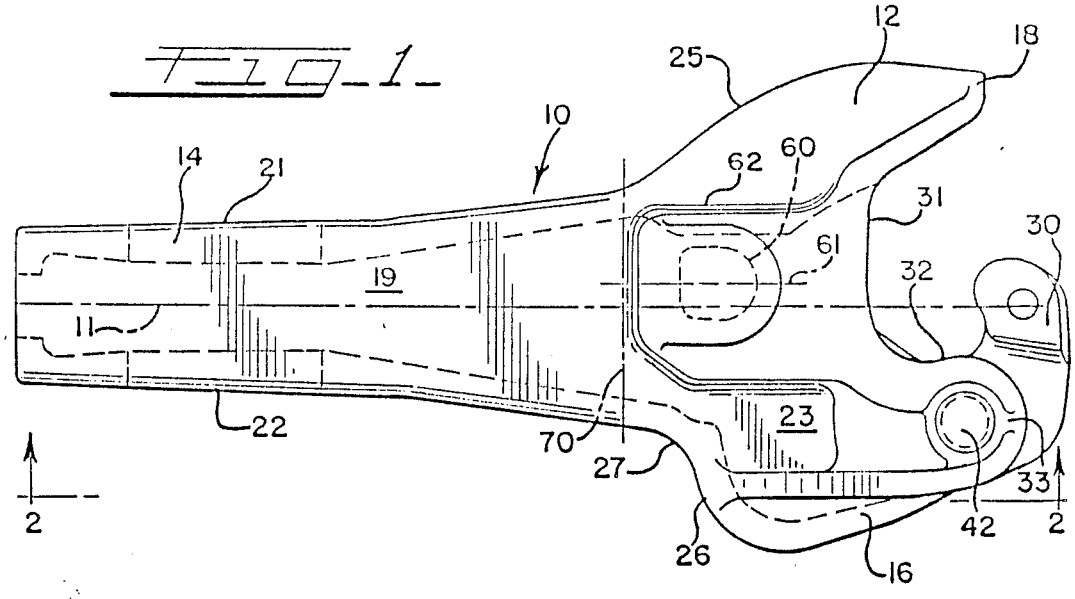
FIG. 1 is a top plan view of an E type coupler embodying the present invention.
Figure 2:
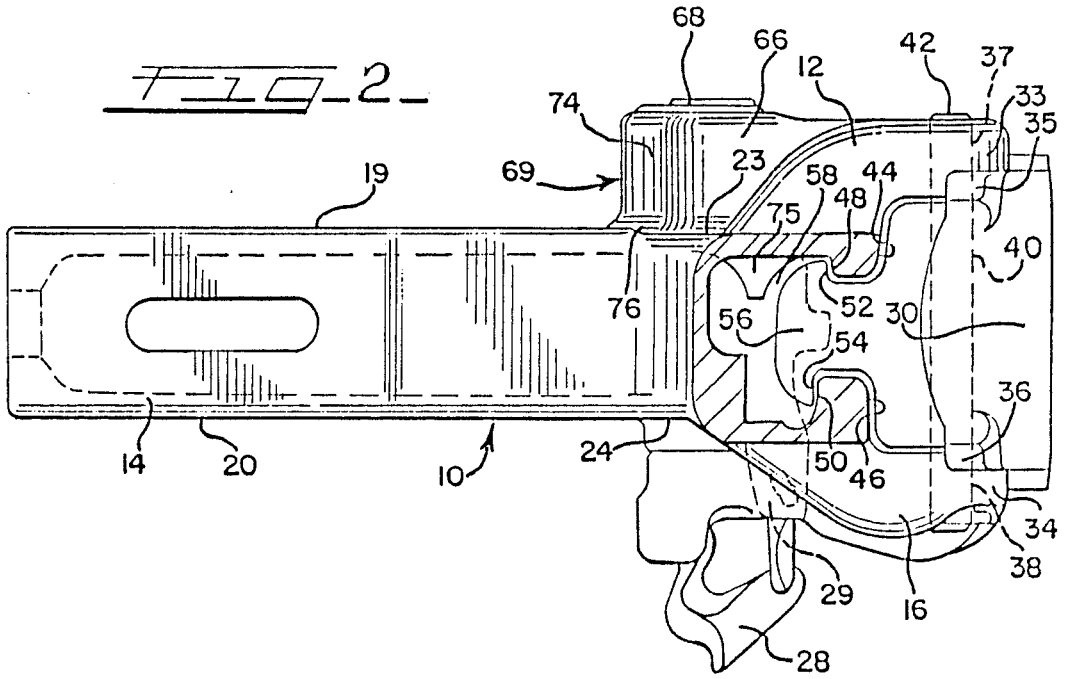
FIG. 2 is a side elevation view, shown partially in cross-section, of the coupler taken along lines 2—2 of FIG. 1.

In FIGS. 1 and 2, an E type coupler embodying the improved design of the present invention is shown generally at 10. The coupler 10 comprises generally a coupler head 12 and a shank 14 which is adapted to be mounted with a draft gear (not shown) in the end of a car sill (not shown) of a railway vehicle (not shown). The knuckle side of coupler head 12 is shown at 16 and the guard arm side at 18. The shank 14 has a generally rectangular cross-section and includes a top face 19, a bottom face 20, a guard arm side face 21 and a knuckle side face 22. Coupler head 12 has a top face 23 and a bottom face 24 substantially coplanar with the shank top and bottom faces 19 and 20, respectively. Furthermore, coupler head 12 has a guard arm side face 25 and a knuckle side face 26 which are on opposite sides of longitudinal center line 11 of coupler 10 and which abut corresponding shank faces 21 and 22, respectively. Knuckle side face 26 of coupler head 12 extends outwardly from corresponding face 22 of shank 14 at arcuate edge 27.

A rotary lock-lift assembly 28 is mounted on coupler head 12 to lift a lock 29 which releases a knuckle 30 from its closed position. Coupler head 12 has a front face 31 including a throat portion 32 extending toward knuckle side 16 in a curved manner toward an upper pivot lug 33 and a lower pivot lug 34. Upper pivot lug 33 narrows toward the knuckle 30 into a pin protector 35. Likewise, lower pivot lug 34 narrows toward the knuckle 30 into a pin protector 36. Upper pivot lug 33 and lower pivot lug 34 include pin apertures 37 and 38, respectively, which together with an aligned pin aperture 40 in the knuckle 30 receive a knuckle pin 42 that pivotally secures the knuckle 30 to the coupler head 12.

Located behind the pivot lugs 33 and 34 are buffing shoulders 44 and 46 which form a pocket for receiving the knuckle 30. Projecting from the buffing shoulders 44 and 46 are an upper pulling lug 48 and a lower pulling lug 50 which are engaged by corresponding pulling surfaces 52 and 54 respectively on a tail 56 of the knuckle 30. Behind the pulling lugs 48 and 50 is a knuckle tail cavity 58 which receives the knuckle tail 56 when the knuckle 30 is in its closed position. The knuckle tail cavity 58 is surrounded on top by the top face 23 of coupler head 12, on bottom by the bottom face 24 of coupler head 12, and on knuckle side 16 by the knuckle side face 26 of coupler head 12.

Figure 3:
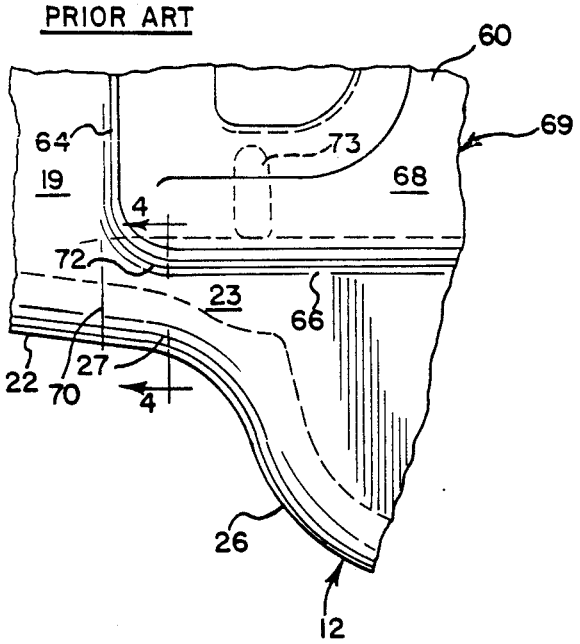
FIG. 3 PRIOR ART
FIG. 3 is an enlarged partial top plan view of a prior art coupler.
Figure 4:
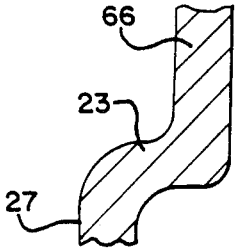
FIG. 4 PRIOR ART
FIG. 4 is a partial cross-sectional view taken along lines 4—4 of FIG. 3.
Figure 5:
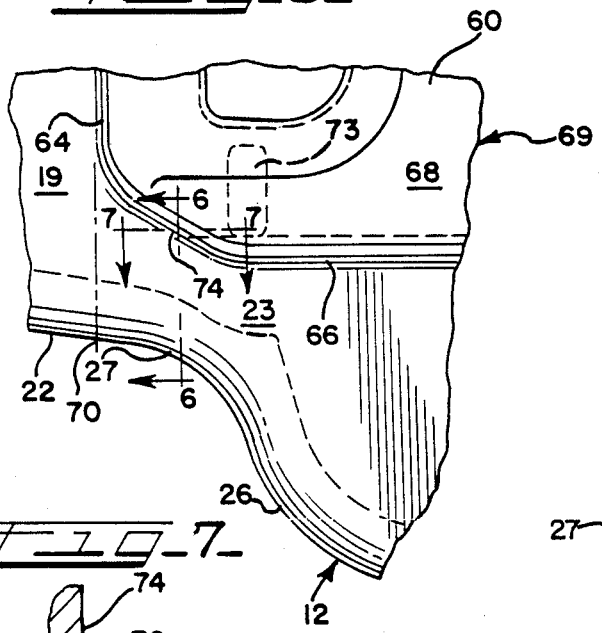
FIG. 5 is an enlarged partial top plan view of the coupler shown in FIG. 1.
Figure 6:
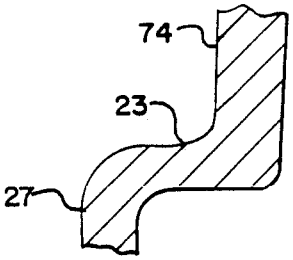
FIG. 6 is a partial cross-sectional view taken along lines 6—6 of FIG. 5.

Knuckle tail cavity 58 abuts a lock cavity (not shown) which is located below a lock chamber 60. The lock cavity and the lock chamber 60 house the lock 29 and have a common longitudinal center line 61 parallel to the longitudinal center line 11 of coupler 10. FIGS. 3 and 4 show part of a lock chamber in a prior art coupler structure, and FIGS. 5–7, in addition to FIGS. 1 and 2, show part of a lock chamber in a coupler structure embodying the present invention, with similar elements being numbered identically. In the prior art arrangement, the lock chamber 60 projects upwardly from the top face 23 of coupler head 12, symmetrically about its longitudinal center line 61, and includes a guard arm side wall 62, a rear horn wall 64, and a knuckle side wall 66, as well as a roof portion 68, all of which constitute a coupler horn 69. The front end of coupler horn 69 is enclosed by the front face 31 of coupler head 12. Transverse to the longitudinal center line of coupler 10 at the rear horn wall 64 is a coupler horn line 70 which is between the top face 23 of coupler head 12 and the corresponding top face 19 of coupler shank 14. The knuckle side wall 66 meets the rear horn wall 64 at a radiused corner 72 on the horn line 70. Extending downwardly along the inside surface of the knuckle side wall 66 is a substantially vertical lock guide 73 which limits rearward movement of the lock 29.

Draft or pulling forces are transmitted from the knuckle 30 to the pin protectors 35 and 36 and the pivot lugs 33 and 34, respectively. Draft forces are also transmitted from the pulling surfaces 52 and 54 of the knuckle tail 56 to the pulling lugs 48 and 50, respectively. The draft forces from the upper pivot lug 33 and the upper pulling lug 48 are then transmitted to the top face 23 of coupler head 12 and the knuckle side wall 66 of lock chamber 60. Likewise, the draft forces from the lower pivot lug 34 and the lower pulling lug 50 are transmitted to the bottom face 24 of coupler head 12 and a lock cavity wall 75 located below knuckle side wall 66 in a lock cavity (not shown) below lock chamber 60.

Since draft loads are applied to the knuckle side 16 of coupler head 12 only, no draft force is transmitted to the guard arm side 18 of coupler head top face 23 or lock chamber guard arm side wall 62. Furthermore, due to the arcuate shape of the knuckle side face 26 of coupler head 12, knuckle side face 26 is not capable of transmitting a large share of the longitudinally directed draft forces. This leaves a major share of the draft forces to be transmitted by the top and bottom faces 23 and 24 of coupler head 12, as well as the knuckle side wall 66 and the lock cavity wall 75 of lock chamber 60. These forces are then transmitted to the respective top and bottom faces 19 and 20 of coupler shank 14.

In addition buff, or compression, forces are also transmitted through the knuckle side 16 of coupler head 12 to coupler shank 14. These buff forces are not of as great a concern as the draft forces since buff loads are applied to both the knuckle side 16 as well as the guard arm side 18 of coupler head 12 and are thus also transmitted through the guard arm side wall 62 of lock chamber 60 in addition to the four walls mentioned above.

Referring again to the prior art arrangement, as can be seen in FIG. 3, the top face 23 of coupler head 12 which, as mentioned, transmits substantially all of the upper longitudinal forces, narrows drastically at the horn line 70 between the arcuate edge 27 of the knuckle side face 26 and the radiused corner 72 resulting in a high local strain condition at this location when draft or buff forces are transmitted as described above. This stress concentration is aggravated further by the fact that the radiused corner 72 inhibits the forces from being transmitted across a significant width of the shank top face 19. Such a strain condition does not occur on the bottom face 24 due to the fact that the drastic narrowing does not occur on that face of the structure.

An additional high concentration of stress occurs at the horn line from the forces transmitted through the knuckle side wall 66. This occurs due to the abrupt radiused termination of the knuckle side wall 66 with the rear horn wall 64 which causes a major share of the forces in the knuckle side wall 66 to be distributed at the single point along the horn line 70 where the knuckle side wall 66 meets the rear horn wall 64. It is the above conditions which have lead to the failures experienced at the horn line 70 of coupler 10 and the necessity to reduce the stress concentration at the horn line 70.

According to the present invention, a portion of lock chamber 60 including the radial corner 72 is removed making lock chamber 60 asymmetrical about its longitudinal center line 61. The rear horn wall 64 has a greater length on the guard arm side than the knuckle side of longitudinal center line 61. In addition, the knuckle side wall 66 has a shorter length than the guard arm side wall 62. The rear horn wall 64 may now be joined to the knuckle side wall 66 with a connecting section. It is important that the connecting section be located to the inward side of both the rear horn wall 64 and the knuckle side wall 66 with respect to lock chamber 60. It is also important that the the rear horn wall 64 and the knuckle side wall 66 not be shortened to the extent that the connecting section will interfere with the lock 29 or the lock guide 73. Such a modified lock chamber provides an increase in section width and strength of the top face 23 of coupler head 12 at the horn line 70.

The preferred form of the connecting section is an angled wall 74 which skews inwardly toward the longitudinal center line 61 from the knuckle side wall 66 to the rear horn wall 64 of lock chamber 60. Substituting the angled wall 74 for the radiused corner 72 of the prior art design reduces the size of lock chamber 60 which increases the section width and strength of the top face 23 of coupler head 12 at the horn line 70 between the arcuate edge 27 and lock chamber 60. Such an increase in the section width of the top face 23 provides for the distribution of forces in the top face 23 over a larger area which results in a reduced stress concentration. The angled wall 74 additionally serves to redirect the forces in top face 23 away from the knuckle side 16 of coupler 10 and over a significant width of corresponding shank top face 19 which also results in a reduced stress concentration.

Figure 7:
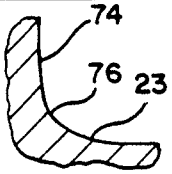
FIG. 7 is a partial cross-sectional view taken along lines 7—7 of FIG. 5.

Furthermore, the major share of forces transmitted by the knuckle side wall 66 are distributed along the angled wall 74 resulting in a reduced concentration of stress as compared to the prior art in which these forces were all distributed at the radiused corner 72. The forces pass through the angled wall 74 to the top face 23 proximate to the horn line 70 in a direction parallel with the longitudinal center line 11 of coupler 10. Accordingly, as shown in FIG. 7, the forces are actually distributed over a compound fillet 76 of variable radii formed by passing angularly through the radial fillet where the substantially vertical angled wall 74 meets the substantially horizontal top face 23. Since the forces are distributed over a larger, smoother curved section area, namely along the entire compound fillet 76, instead of the radial fillet of the prior art design, this too acts to reduce the stress concentration at the horn line 70 of coupler head top face 23.

The combined reductions of stress concentration described above resulting from the substitution of the angled wall 74 for the radiused corner 72 results in a lessened likelihood that a coupler failure will occur at the coupler horn line 70 between the arcuate edge 27 of coupler head knuckle side face 26 and lock chamber 60.

The foregoing description and drawings explain and illustrate the best known mode of the invention and those skilled in the art who have the disclosure before them will be able to make modifications and variations therein without departing from the scope of the invention which is defined in the following claims.

What is claimed is:

1. An improved coupler head for use in joining adjacent railway vehicles, said coupler head of the type having a guard arm side and a knuckle side, and a lock chamber projecting upwardly from a top face thereon with a guard arm side wall, a knuckle side wall parallel to said guard arm side wall, and a rear horn wall perpendicular to said guard arm side wall and said knuckle side wall, the improvement in which:

said lock chamber is asymmetrical with respect to its longitudinal center line such that said rear horn wall has a greater length on said guard arm side of said longitudinal center line than said knuckle side of said longitudinal center line and said knuckle side wall of said lock chamber has a shorter length than said guard arm side wall of said lock chamber;

said rear horn wall is joined to said knuckle side wall on said knuckle side of said longitudinal center line by a connecting section, said connecting section being located inwardly of said rear horn wall and said knuckle side wall with respect to said lock chamber.

2. The invention according to claim 1 in which said connecting section comprises an angled wall which skews inwardly from said knuckle side wall to meet said rear horn wall.

* * * * *